US007196278B2

(12) United States Patent
Kurek et al.

(10) Patent No.: US 7,196,278 B2
(45) Date of Patent: Mar. 27, 2007

(54) KEY OPERATED SECURITY SWITCH

(75) Inventors: Stephen R. Kurek, Rego Park, NY (US); Anthony Tufano, North Massapequa, NY (US); Arkady Getselis, New York, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/367,933

(22) Filed: Mar. 3, 2006

(65) Prior Publication Data

US 2006/0201794 A1 Sep. 14, 2006

Related U.S. Application Data

(60) Provisional application No. 60/658,081, filed on Mar. 3, 2005.

(51) Int. Cl.
*H01H 27/06* (2006.01)

(52) U.S. Cl. ..... 200/43.08; 200/568; 200/569

(58) Field of Classification Search ..... 200/11 R, 200/11 A, 11 G, 11 H, 16 R–16 D, 43.01, 200/43.04, 43.08, 43.11, 50.09, 329, 330, 200/334, 564, 568, 569, 572, 336
See application file for complete search history.

(56) References Cited

U.S. PATENT DOCUMENTS

| | | | | |
|---|---|---|---|---|
| 3,714,383 | A * | 1/1973 | Leonard et al. | 200/43.08 |
| 3,723,677 | A * | 3/1973 | Arias | 200/43.04 |
| 3,858,012 | A * | 12/1974 | Lockard | 200/16 D |
| 3,906,176 | A * | 9/1975 | Carlson | 200/43.04 |
| 4,107,484 | A * | 8/1978 | Petersen, III | 200/43.04 |
| 4,511,770 | A * | 4/1985 | Hayashida | 200/6 B |
| 5,725,087 | A * | 3/1998 | Ives | 200/330 |

* cited by examiner

*Primary Examiner*—Michael A. Friedhofer
(74) *Attorney, Agent, or Firm*—Paul J. Sutton

(57) ABSTRACT

A key operated switch that provides enhanced operational characteristics wherein the rotary motion of a key is translated into the actuation of a switch mechanism that rapidly establishes an electrical connection between a source of electrical current and a load. The switch uses a toggle adapted to interact with a standard switching mechanism which reduces the number of components and the cost of the switch. The key cylinder is coupled to a yieldable member such as spring to provide a positive or snap action when the key cylinder is rotated with a prescribed arc of rotation which reduces the complexity of the switch.

10 Claims, 5 Drawing Sheets

KEY OPERATED SECURITY SWITCH

This application claims the benefit of the filing date of a provisional application having Ser. No. 60/658,081 which was filed on Mar. 3, 2005.

BACKGROUND OF THE INVENTION

1. Field of the Invention

The present invention relates to the field of electrical switches. More specifically, this invention relates to a key operated security switch.

2. Description of the Related Art

Key operated switches are common in the art and are used to provide a means to conveniently and affirmatively switch electrical current. Key operated switches provide added security by permitting only those individuals with a key to operate the switch. Many variations of key operated switches exist that utilize a key which acts upon a mechanism to connect a load or device to an electrical current. A typical example is a key operated switch that requires that a key be inserted into a lock mechanism and rotated at least 60 degrees in a particular direction in order to switch power on. To switch the power to a load off, the actuation process is reversed. Switches of this type can be quite complicated and often require many specialized and expensive parts to convert the action of turning a key in the switch into the actuation of the device itself Moreover, switches of this type generally require that the key be rotated at least 90 degrees in a particular direction to actuate the device.

The present invention seeks to improve on the prior art by providing a switch that provides a reduced number of moving parts, can be produced at reduced cost and provides improved operational characteristics.

SUMMARY OF THE INVENTION

The present invention is a switch that provides enhanced operational characteristics wherein the rotary motion of a key is translated into the actuation of a switching mechanism that rapidly establishes an electrical connection between a source of electrical current and a load. The switch comprises an actuator coupled between a key cylinder and a toggle. When a key is placed in the key cylinder and rotated within an arc of rotation of approximately 60 degrees, the rotation of the key cylinder engages the actuator which converts the rotation of the key cylinder into a rotation of the toggle causing the toggle to trigger a switch mechanism. The switch uses a toggle adapted to interact with a standard switching mechanism which reduces the number of components and the cost of the switch. The key cylinder is coupled to a yieldable member such as spring to provide a positive or snap action when the key cylinder is rotated with the prescribed arc of rotation which thus reducing the complexity and improving the operational characteristics of the switch.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features and advantages of the present invention will become more fully apparent from the following detailed description, the appended claim, and the accompanying drawing in which similar elements are given similar reference numerals wherein:

DETAILED DESCRIPTION OF THE INVENTION

Figure 1:
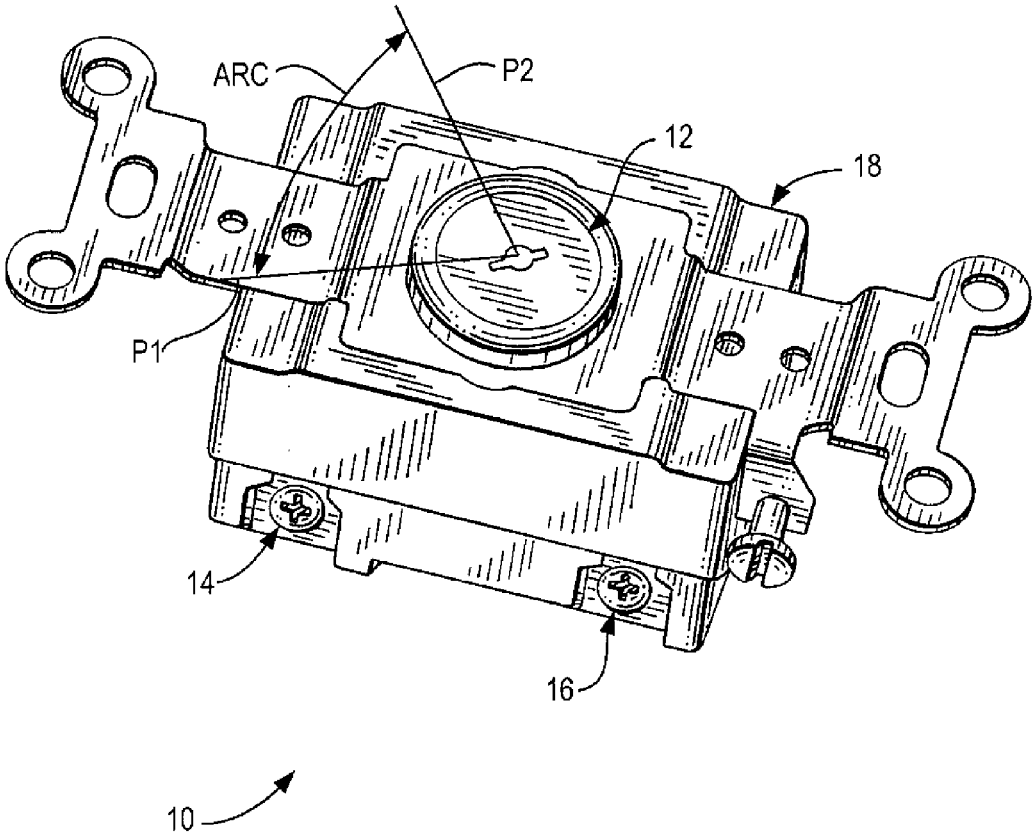
FIG. 1 is a perspective view of an assembled switch according to the present invention.

FIG. 1 shows a key operated switch 10 according to an embodiment of the present invention. The switch includes a key cylinder 12 which is capable of being rotated between a fir st position P1 and a second potion P2 spanning an arc of approximately sixty (60) degrees. The switch 10 includes a switching mechanism configured as a single pole single throw (SPST) 3 way switch with an input terminal 14 for connection to a power source (not shown), a first output terminal 18 for connection to a first load (not shown) and a second output terminal 16 for connection to a second load (not shown). In operation, a key (not shown) is inserted into the key cylinder 12 and then rotated to the first position P1 which makes a first conductive path between the input terminal 14 and the first output terminal 18 and, simultaneously, breaks a second conductive path between the input terminal 14 and the second output terminal 16. The key can also be rotated to the second position P2 which breaks the first conductive pat and, simultaneously, makes the second conductive path.

Figure 2:
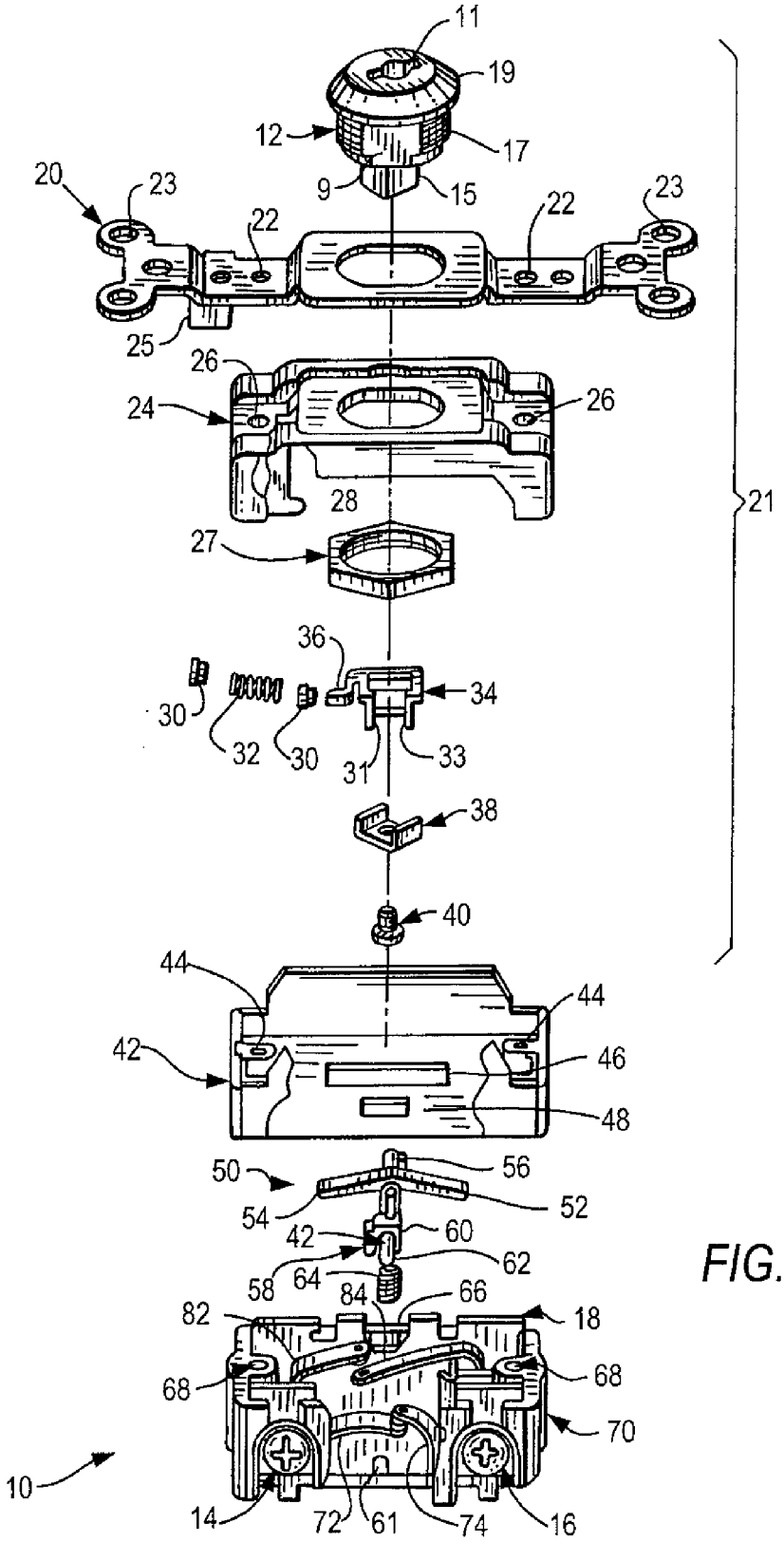
FIG. 2 is an exploded view of the switch of FIG. 1.
Figure 3A:
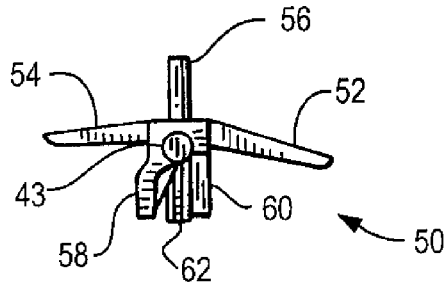
FIG. 3A is a side view of the toggle of FIG. 2.
Figure 3B:
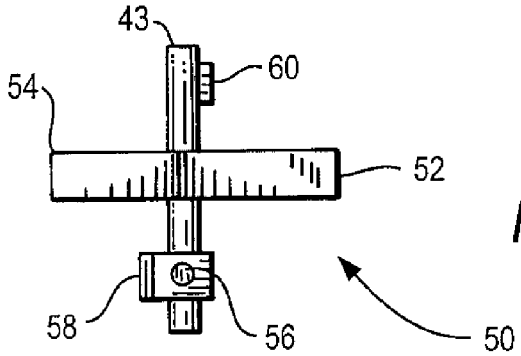
FIG. 3B is a top view of the toggle of FIG. 3A.
Figure 3C:
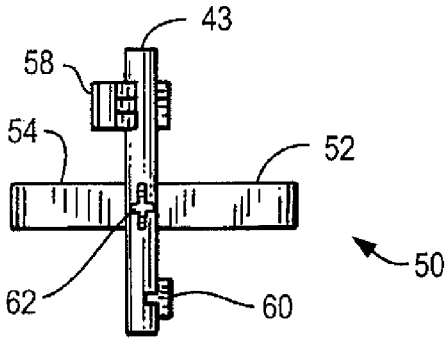
FIG. 3C is a bottom view of the toggle of FIG. 3A.
Figure 3D:
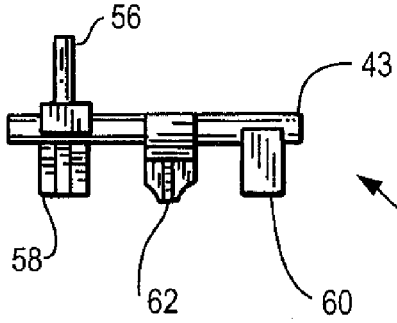
FIG. 3D is a front view of the toggle of FIG. 3A.

FIG. 2 shows an exploded view of the key operated switch 10 of FIG. 1. The actuator 34 is coupled between the key cylinder 12 and the toggle 50. When a key (not shown) is placed in the key cylinder 12 and rotated within the prescribed arc of rotation (see FIG. 1), the rotation of the key cylinder 12 engages the actuator 34 which converts the rotation of the key cylinder into a rotation of the toggle causing the toggle to trigger a switch mechanism located within switch housing 70. The toggle 50 is adapted to interact with the switch mechanism which is a standard switch mechanism thereby reducing the number of components and the cost of the switch. The key cylinder 12 is coupled to a yieldable member such as spring 32 to provide a positive or snap action when the key cylinder is rotated with the prescribed arc of rotation which increases the performance and reduces the complexity of the switch.

The key cylinder 12 comprises a central body 17 having a top portion 19 with a key opening 11 for receiving a key (not shown) and a bottom portion 15 for coupling to the actuator 34. The top portion 19 has a generally circular shape with a diameter dimensioned to allow the key cylinder 12 to sit over the central opening of the ground strap 20 without having it extend through the central opening. The central body 17 has a generally cylindrical shape with two flat portions 9 (one shown) on opposite sides dimensioned to extend through similarly shaped central openings of the ground strap 20 and the top cover 24. The configuration of the central body 17 provides an indexed mounting mechanism to enable the key cylinder 12 to be mounted in a particular orientation.

The bottom portion 15 of the key cylinder 12 is generally square shaped and dimensioned to fit within the square shaped opening of the top portion of the actuator 34. A fastening assembly comprising a square shaped clamp 38 and screw 40 is used to secure the bottom portion 15 of the key cylinder 12 to the top portion of the actuator 34. A threaded lock nut 27 is fastened to the central body 17 to secure the key cylinder 12 to the ground strap 20 and to the top cover 24. The key cylinder 12 is operatively coupled to the actuator 34 such that the key cylinder rotates together with the actuator 34. A top yieldable member shown as a spring 32 provides snap action mechanism when the key cylinder is rotated between the first and second positions P1, P2 (see FIG. 1). One end of the spring 32 is coupled to a tab 28 located on the inside wall of the top cover 24 and the other end of the spring 32 is coupled to a tab 36 located on a side wall of the actuator 34. Spring inserts 30 are used at each end of the spring to provide a more secure connection.

The switch housing 70 supports a switching mechanism capable of having a first on position and a second on position. When the key cylinder 12 is moved to the first position P1 (sec FIG. 1), the switch is placed in on position which causes a first conductive path to be made between the input terminal 14 and the first output terminal 18 and a second conductive path to be broken between the input terminal 14 and the second output terminal 16. When the key cylinder 12 is moved to the second position P2 (see FIG. 1), the reverse occurs, such that switch moves to the second on position causing the first conductive path to be broken and the second conductive path to be made. Thus, the switching mechanism by making either the first or second conductive paths but not both conductive paths simultaneously. In other words, when the first conductive path is made, the second conductive pat is broken and when the first conductive path is broken, the second conductive path is made.

The input terminal 14 comprises a screw/clamp assembly for attaching to a conductor such as a wire conductor carrying a current from a power source of an electrical wiring system. The input terminal 14 also includes a first input conductor 72 and a second input conductor 82. The first input conductor 72 is capable of forming the first conductive path by making electrical contact with a first output conductor 74 of the first output terminal 16 Likewise, the second input conductor 82 is capable of forming the second conductive path by making electrical contact with a second output conductor 84 of the second output terminal 18. The first and second output terminals 16, 18 include a screw/clamp assembly for attaching to a conductor such as a wire conductor from a load of an electrical wiring system. The conductors 72, 74, 82 and 84 can be yieldable electrical conductors made from relatively thin metallic strips or other configurations. Electrical Contacts are provided at the free end of the conductors 72, 74, 82 and 84 to improve the electrical contact between the conductors.

The toggle 50 is operatively coupled to the key cylinder 12 through the actuator 34. The toggle is configured to respond to the rotation of the key cylinder and alternatively make and break the first and second conductive paths of the switching mechanism. The toggle 50 comprises a rod 43 made of plastic with opposite ends to pivot about holders 66 (one shown) located on opposite side walls of the housing 70 (see FIGS. 3A through 3D for further details of the toggle). The bottom portion of the toggle 50 supports a first actuating lobe 58 located to contact the first input conductor 72 and a second actuating lobe 60, spaced apart from the first actuating lobe along the longitudinal axis of the rod, to contact the second output conductor 84. The top portion of the toggle 50 supports an actuator pin 56 made of metal positioned to fit within the side walls 31, 33 of the bottom portion of the actuator 34. A bottom yieldable member such as spring 64 has a top end coupled to a tab 62 on the bottom portion of the toggle 50 and a bottom end coupled to a tab 61 located on the inside base of the housing 70. The spring 64 provides an upward bias to the toggle 50 to maintain the toggle in one of two positions (see FIGS. 4B and 5B). First and second stopper arms 52, 54 are located transversely to the longitudinal axis of the toggle and are located to contact stopper posts 51, 53 (see FIG. 4B) to prevent the toggle 50 from rotating or pivoting beyond a predetermined position. The stopper posts 51, 53 are made of rubber material to absorb the downward force of the stopper arms 52, 54.

The middle cover 42 comprises a housing with a pin opening 48 located and sized to allow the actuator pin 56 of the toggle 50 to extend through the opening to interact with the bottom portion of the actuator 34. The middle cover 42 also includes a stopper arm opening 46 located and sized to allow the stopper arms 52, 54 to extend through the opening when the arms alternatively pivot upward and downward. The ground strap 20, the top cover 24, the middle cover 42 and the switch housing 70 are secured together to form the switch assembly by inserting screws (not shown) through openings 68 in the housing 70, openings 44 in the middle cover 42, openings 26 in the top cover 24 and openings 22 in the ground strap 20.

The ground strap 20 includes a ground terminal 25 for connection to a ground conductor (not shown) and ears 23 for attachment to an electrical junction box (not show). The ground strap 20 is made of conductive material such as galvanized steel or other conductive material. The top cover 24, the middle cover 42 and the housing 70 are made of non-conductive material such as plastic or other non-conductive material. The top spring 32 and bottom spring 64 are yieldable or compressible members made of metallic material but other techniques and other materials such as plastic can be used.

Figure 4A:
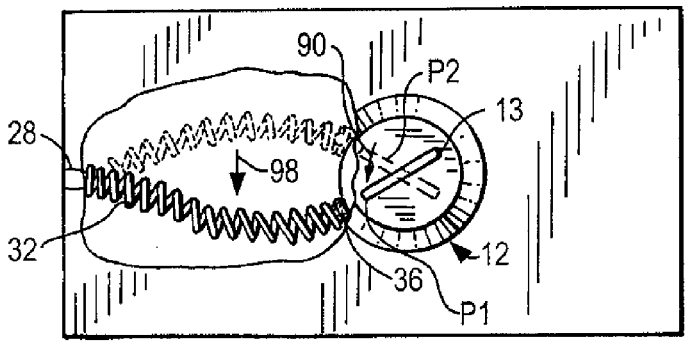
FIG. 4A is a top view of the switch in the first position.
Figure 4B:
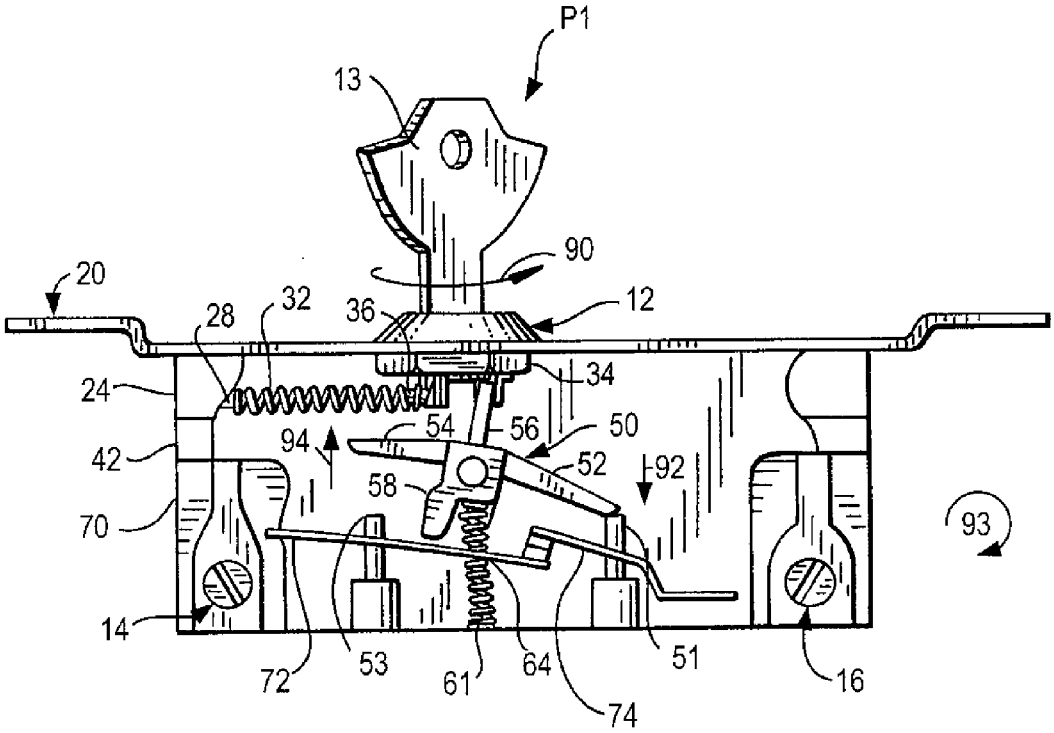
FIG. 4B is a cutaway side view of the switch in the first position.

FIG. 4A is top view of the switch 10 in a first position PI and FIG. 4B is a cutaway side view of the switch 10. A explained below in detail, in the first position P1, the first conductive path is made and the second conductive path is broken (not shown). Referring to FIG. 4A, it is assumed that the key cylinder 12 is rotated to the first position P1 from the second position P2. In operation, a key 13 is inserted into the key cylinder 12 and rotated in a counterclockwise direction (arrow 90) along the longitudinal axis of the key cylinder with sufficient force to compress the spring. Further rotation causes the spring to uncompress and flex in the direction of arrow 98 which urges the key cylinder 12 to the first position P1 thereby providing a positive or snap action movement. If an insufficient force is applied, then the bias of the spring 32 prevents the switch from moving to the first position P1 thereby maintaining the switch in the second position P2.

Referring to FIG. 4B, the rotation of the key cylinder in the counterclockwise direction (arrow 90) causes the actuator 34 to rotate in the same direction. As the actuator 34 rotates in the counterclockwise rotation (arrow 90), the side walls of the actuator 34 contact the actuator pin 56 of the toggle 50 causing the toggle to rotate in a clockwise direction (arrow 93) along an axis perpendicular to the rotation of the key cylinder (arrow 90). This clockwise rotation (arrow 93) of the toggle must be of sufficient force to overcome the upward bias (arrow 94) of the bottom spring 64 which maintains the toggle in a particular position. Assuming that this clockwise rotation (arrow 93) is with sufficient force, then the clockwise rotation causes the first lobe 58 to move upward (arrow 94) away from the first input conductor 72 which allows the first input conductor 72 to move upward (arrow 94) because of the upward bias of the first input conductor. As the first conductor 72 moves upward, it will make electrical contact with the first output conductor 74 thereby making the first conductive path. Although not shown, simultaneous with the upward motion of the first lobe 58, the second lobe 60 (see FIG. 2) moves in the opposite direction (downward as shown by arrow 92) urging the second output conductor 84 downward thereby breaking the second conductive path between the second input conductor 82 and the second output conductor 84. In addition, the rotation of the toggle 50 in the clockwise direction (arrow 93) causes the second arm 54 to move upward (arrow 94) and the first arm 52 to move downward (arrow 92) until it contacts stopper element 51 which prevents the toggle from further rotation. Moreover, the central portion of the spring 64 flexes towards the left direction (arrow 96) which maintains the toggle in the first position until an opposite force is applied to move the switch to the second position.

Figure 5A:
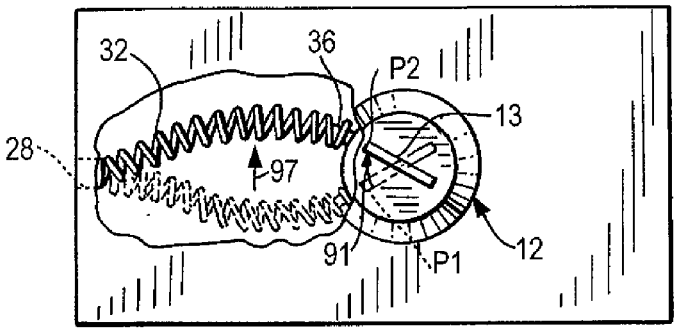
FIG. 5A is a top view of the switch in the second position.
Figure 5B:
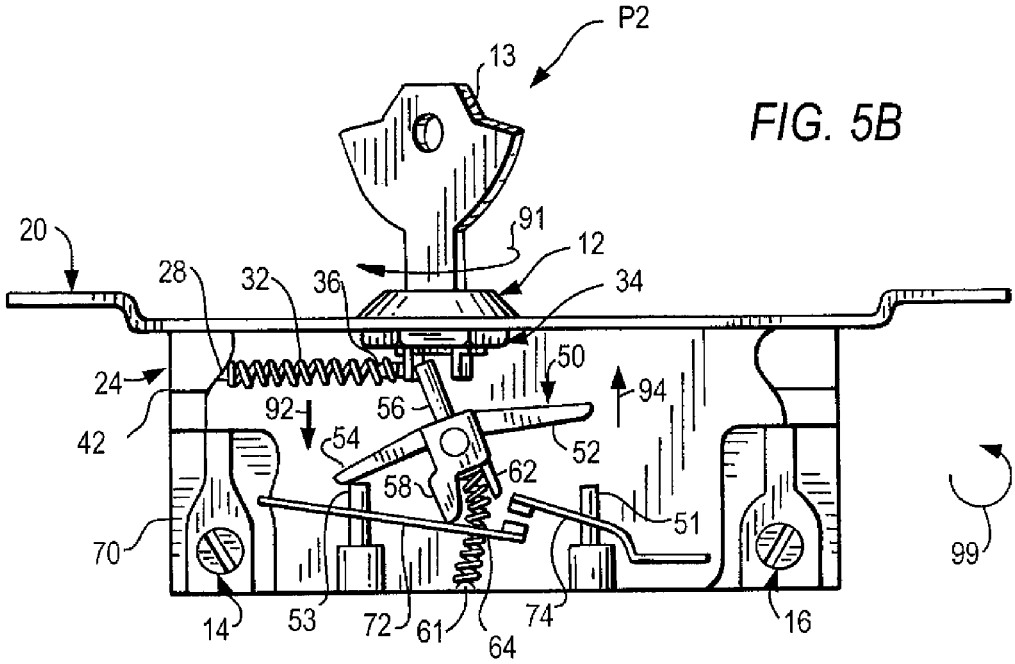
FIG. 5B is a cutaway side view of the switch in the second position.

FIG. 5A is a top view of the switch in the second position P2 and FIG. 5B is a cutaway side view of the switch in the second position P2. A explained below in detail, in the second position P2, the first conductive path is broken and the second conductive path is made (not shown). Referring to FIG. 5A, it is assumed that the key cylinder 12 is rotated to the second position P2 from the first position P1. In operation, the key 13 is inserted into the key cylinder 12 and rotated in a clockwise direction (arrow 91) along the longitudinal axis of the key cylinder with sufficient force to compress the spring. Further rotation causes the spring to uncompress and flex in the direction of arrow 97 which urges the key cylinder 12 to the second position P2 thereby providing a positive or snap action movement. If an insufficient force is applied, then the bias of the spring 32 prevents the key cylinder 12 from moving to the second position P2 thereby maintaining the switch in the first position P1.

Referring to FIG. 5B, the rotation of the key cylinder in the clockwise direction (arrow 91) causes the actuator 34 to rotate in the same direction. As the actuator 34 rotates in the clockwise rotation (arrow 91), the side walls of the actuator 34 contact the actuator pin 56 of the toggle 50 causing the toggle to rotate in a counterclockwise direction (arrow 99) along an axis perpendicular to the rotation of the key cylinder (arrow 91). This counterclockwise rotation (arrow 99) of the toggle must be of sufficient force to overcome the upward bias (arrow 94) of the bottom spring 64 which maintains the toggle in a particular position. Assuming that this counterclockwise rotation (arrow 99) is with sufficient force, then the counterclockwise rotation causes the first lobe 58 to move downward (arrow 92) urging the first input conductor 72 in the downward direction (arrow 92) toward the second output conductor 74 thereby making the first conductive path between the first input conductor 72 and the first output conductor 74. Although not shown, simultaneous with the downward motion of the first lobe 58, the second lobe 60 (see FIG. 2) moves in the opposite direction (upward as shown by arrow 94) allowing the second output conductor 84 to move upward because of the upward bias of the second output conductor thereby making the second conductive path between the second input conductor 82 and the second output conductor 84. In addition, the rotation of the toggle in the counterclockwise direction (arrow 99) causes the first arm 52 to move upward (arrow 94) and the second arm 54 to move downward (arrow 92) until it contacts stopper element 53 which prevents the toggle from further rotation. Moreover, the central portion of the spring 64 flexes towards the right direction (arrow 95) which maintains the toggle in the second position until an opposite force is applied to move the switch to the first position.

It should be apparent to one skilled in the art that although the disclosure focuses on a SPDT switch, similar techniques can also be used with other electrical switches such as double pole switch, 3-way switch, 4-way switch and other devices, without departing from the spirit or the scope of the invention. For example, the switch of the present invention can be configured as an on/off switch such as a single pole single throw (SPST) switch with a single input terminal and single output terminal. In the SPST configuration, when the switch is in the first position P1, a conductive path is made between the input and output terminal thereby connecting power to a single load and, when in the second position P2, the conductive path is broken thereby disconnecting power from the load.

While the invention has been described in detail and with reference to specific embodiments thereof, it will be apparent to those skilled in the art that various changes and modifications can be made therein without departing from the spirit and scope thereof Thus, it is intended that the present invention cover the modifications and variations of this invention provided they come within the scope of the appended claims and their equivalents.

What is claimed is:

1. A key operated switch comprising:

a key cylinder rotatable between at least a first position and a second position when a key is inserted into the cylinder;

an actuator coupled to the key cylinder;

a toggle coupled to the actuator wherein the toggle has at least one actuating lobe; and a switch for establishing a first conductive path between a power source and a first load when the switch is placed in a first conductive position and establishing a second conductive path between the power source and a second load when the switch is placed in a second conductive position, and wherein placing the switch in said second conductive position causes the switch to simultaneously break said first conductive path to said first load, and wherein the switch is operatively coupled to the toggle wherein rotation of the cylinder by the key from the first position to the second position causes the actuator to urge the at least one actuating lobe to place the switch in the second conductive position and wherein rotation of the cylinder from the second position to the first position causes the actuator to urge the at least one actuating lobe to place the switch in the first conductive position.

2. The key operated switch of claim 1 wherein the actuator is fixedly coupled to the key cylinder.

3. The key operated switch of claim 1 wherein the actuator is coupled to a yieldable member which maintains the actuator in the first position when the cylinder is rotated to the first position and in the second position when the cylinder is rotated to the second position.

4. The key operated switch of claim 3 wherein the yieldable member is a spring.

5. The key operated switch of claim 1 wherein the key cylinder rotates in a first axis and the toggle rotates in a second axis which is perpendicular to the first axis.

6. The key operated switch of claim 1 wherein the toggle is coupled to a yieldable member which maintains the toggle in the on position when the toggle is urged to the on position and maintains the toggle in the off position when the toggle is urged to the off position.

7. The key operated switch of claim 6 wherein the yieldable member is a spring.

8. The key operated switch of claim 1 wherein the actuator comprises a clamp with side walls which interacts with a pin of the toggle.

9. The key operated switch of claim 1 wherein the switch comprises an input yieldable conductor and an output yieldable conductor wherein, when the switch is moved to the on position, the input conductor is biased to cause the input conductor to move towards the output conductor to make electrical contact with the output conductor and, when the switch is moved to the off position, the actuating lobe urges the input conductor to move away from the output conductor to break electrical contact with the second conductor.

10. The key operated switch of claim 1 wherein the input and output conductors are yieldable metallic strips.

* * * * *